US008763993B2

(12) United States Patent
Böhler

(10) Patent No.: US 8,763,993 B2
(45) Date of Patent: Jul. 1, 2014

(54) CRANE HOOK ASSEMBLY HAVING A HOOK WEIGHT ARRANGEMENT

(75) Inventor: Stefan Böhler, Albbruch (DE)

(73) Assignee: Rotzler GmbH + Co. KG, Steinen (DE)

( * ) Notice: Subject to any disclaimer, the term of this patent is extended or adjusted under 35 U.S.C. 154(b) by 238 days.

(21) Appl. No.: 13/111,255

(22) Filed: May 19, 2011

(65) Prior Publication Data

US 2011/0285157 A1 Nov. 24, 2011

(30) Foreign Application Priority Data

May 20, 2010 (EP) ..... 10005295

(51) Int. Cl.
*B66D 3/04* (2006.01)

(52) U.S. Cl.
USPC ..... 254/390; 254/405

(58) Field of Classification Search
USPC ..... 254/390, 405, 393, 401, 402; 212/326, 212/327; 294/82.1, 82.11, 82.12
See application file for complete search history.

(56) References Cited

U.S. PATENT DOCUMENTS 1,625,552 A * 4/1927 Lewis ..... 294/82.1
2,027,279 A * 1/1936 Lee ..... 254/405
2,359,027 A * 9/1944 Flynn ..... 254/401
2,502,570 A * 4/1950 Johnson ..... 254/402
2,622,846 A * 12/1952 Bennett ..... 254/402
2,650,403 A * 9/1953 Taylor, Jr. et al. ..... 294/82.2
3,917,334 A * 11/1975 Koster ..... 294/82.1
5,451,032 A * 9/1995 Rhoads ..... 254/399
7,219,937 B2 * 5/2007 Stober et al. ..... 294/82.1

FOREIGN PATENT DOCUMENTS

JP 5-75271 U 10/1993
JP 10-139363 A 5/1998

OTHER PUBLICATIONS

European Search Report dated Oct. 25, 2010 of European application 10 005 295.0 on which this application is based.

* cited by examiner

*Primary Examiner* — Emmanuel M Marcelo
*Assistant Examiner* — Justin Stefanon
(74) *Attorney, Agent, or Firm* — Walter Ottesen P.A.

(57) ABSTRACT

A crane hook assembly having a hook weight arrangement serves for applying a tension load to a rope (2). The rope can be wound onto or off a rope drum on a crane and lifts or lowers the crane hook (4). The hook weight arrangement (1*) includes a hook weight body (3) connected to the rope (2) and an additional weight (26) which is attachable thereto. The rope (2) is guided through an opening (10, 6) in the hook weight body (3, 3*), and the crane hook (4) is attached on the bottom end (20) of the hook weight body (3, 3*).

14 Claims, 4 Drawing Sheets

CRANE HOOK ASSEMBLY HAVING A HOOK WEIGHT ARRANGEMENT

CROSS REFERENCE TO RELATED APPLICATION

This application claims priority of European patent application no. 10 005 295.0, filed May 20, 2010, the entire content of which is incorporated herein by reference.

FIELD OF THE INVENTION

The invention relates to a crane hook assembly having a hook weight arrangement for applying tension to a rope.

BACKGROUND OF THE INVENTION

A certain tensile load in the rope is required so that ropes on cranes can be securely wound up or unwound even when there is no load on the crane hook. A hook weight arrangement is provided through which the rope is stretched in order to generate the required tensile load. The hook weight is usually two percent of the breaking load of the rope. Accordingly, at a breaking load of 10 tons, the hook weight is 200 kilogram. When the crane rope has a double pull only half the weight acts upon each strand so that the weight is to be doubled in this case. Such large weights are manageable only with corresponding machine apparatus, which makes their use more difficult.

SUMMARY OF THE INVENTION

It is an object of the invention to provide a crane hook assembly with a hook weight arrangement which is easier to handle and can be universally used.

The crane hook assembly of the invention is for a crane having a rope drum. The crane hook assembly includes: a crane hook; a rope arranged to be alternately wound onto or unwound from the rope drum of the crane for lifting and lowering the crane hook; a hook weight arrangement configured for applying a tension load to the rope; the hook weight arrangement including a hook weight body connected to the rope and an additional weight configured to be attachable to the hook weight body; the hook weight body having a lower end and defining an opening configured to have the rope guided therethrough; the crane hook being attached to the lower end of the hook weight body; the hook weight body having a substantially cylindrical section in the vertical direction; the additional weight including at least two jacket parts shaped as annular sections which conjointly assume an essentially cylindrical form; and, the jacket parts annularly surrounding the hook weight body when attached thereto.

The invention offers the possibility of using the hook weight arrangement in a variety of ways. As long as the weight of the hook weight body is sufficient for use on a single pull, it can be used without any additional weight. If, however, the weight of the hook weight body is not sufficient, then the additional weight is attached thereto and the tension load in the rope is correspondingly increased thereby. When a double pull is used, there is a deflection of the rope which results in halving of the required pulling force. In this case a hook weight arrangement comprising a hook weight body and an additional weight fixed thereon is used. The magnitude of the additional weight can be selected according to the required tension loading.

The additional weight is formed of at least two parts. In this manner, the individual parts of the additional weight are limited in terms of size and weight. Thus, handling of the individual parts is made easier. Further, it is advantageous that the hook weight body has an essentially cylindrical section in the vertical direction and the additional weight is formed of jacket parts which annularly surround the hook weight body. In this manner, an even weight distribution in relation to the longitudinal center axis of the hook weight arrangement results. The opening in the hook weight body may be a cutout or a slot.

In a further embodiment, two diametrically arranged gaps are formed between the jacket parts of the additional weight through which gaps the rope can be guided. This arrangement serves as the entrance and exit of the rope in a double pull. The rope is guided via a rope pulley mounted in the hook weight body. Preferably, the circumferential edge of the rope pulley projects into the gaps.

In a further embodiment, the jacket parts are provided with opposingly directed protrusions on which the jacket parts come to rest. Elements for the form-fitting interlocking of the jacket parts are provided on these projections so that a secure fit on the hook weight body is ensured.

The additional weight or, more specifically, jacket parts defining the additional weight are, as a practical matter, made of gray cast iron. The parts of the additional weight can, for example, be fixed on the hook weight body via threaded fastener connections. Alternatively hereto, it is also possible to provide coaxial bores in the parts of the additional weight and in the hook weight body and to use bolts for the fixation of the parts. In a further embodiment, it is considered to be practical that the bores in the hook weight body have a larger diameter and a sleeve is provided in the bores on which a rope pulley is mounted. For secure positioning of the sleeve, it can be practical to provide holders for the sleeve at the bores.

In a further embodiment, a bore running transversely to the longitudinal axis is provided in the hook weight body and a bolt is used therein to fix the rope. In a further embodiment, two flanges are arranged on the bottom end of the hook weight body for receiving a bolt and a bracket is hung on the bolt. The hook with a pivot assembly is attached to the bracket. For feeding the rope in a single pull, it is suggested that the slot in the hook weight body be connected with an upper end via a cutout which has a widening in which a closing member can be inserted. Between the closing member and the upper end of the hook weight body, an opening is formed via a corresponding recess for guiding the rope therethrough. In order to further reduce the weight of the parts to be handled, it is considered to be practical that the hook weight body has a partition plane in its longitudinal direction so that the hook weight body has two parts which are preferably of approximately the same size. Thus, for the purpose of transport and handling at the destination, the weight of the parts forming the hook weight body is halved and the hook weight body will be assembled at the destination.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
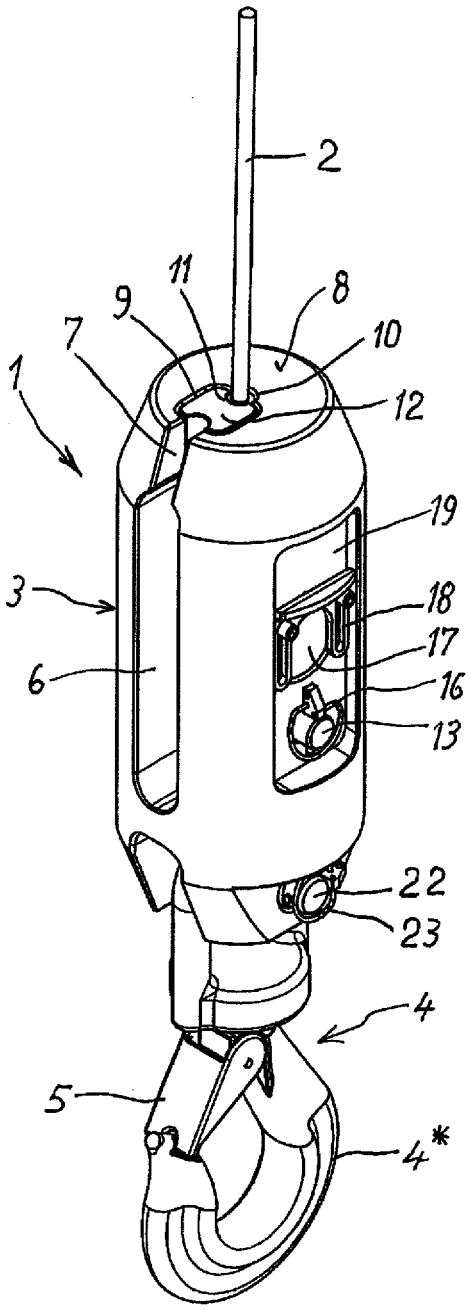
FIG. 1 is a perspective view of a hook weight arrangement with a removed additional weight for a single pull.
Figure 2:
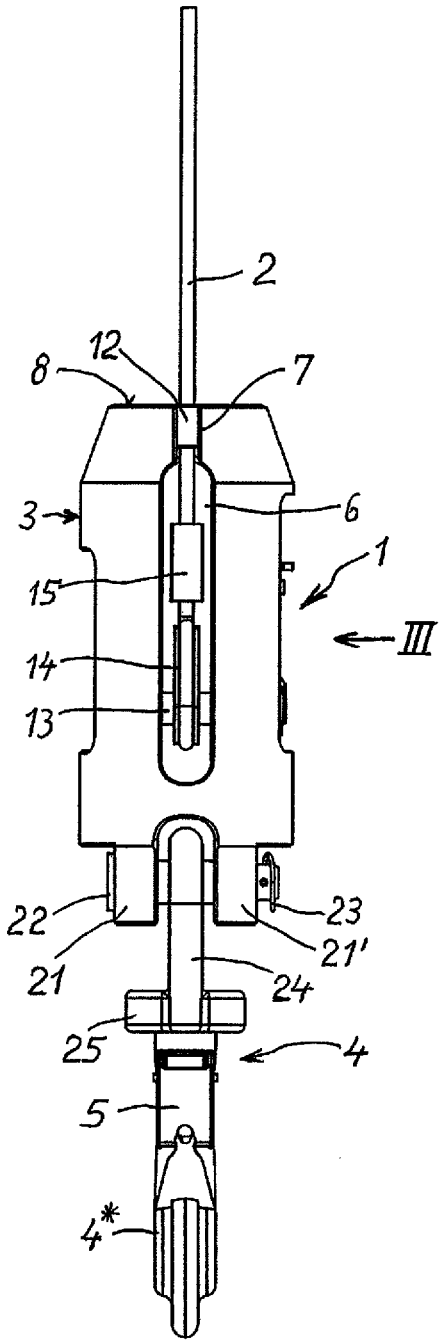
FIG. 2 is a side view of the hook weight arrangement of FIG. 1.

FIGS. 1 and 2 show a hook weight arrangement 1 hanging on a rope 2 of a crane. The rope is of a single pull configuration. The hook weight arrangement 1 includes a hook weight body 3, preferably made of gray cast iron, and a crane hook 4 attached thereto. The crane hook 4 includes a hook 4*, a safety latch 5, a pivot assembly 25, and a bracket 24. The hook weight body 3 has an essentially cylindrical section in whose region the hook weight body 3 has a slot 6 running in the longitudinal direction and diametrically penetrating the hook weight body 3. The slot 6 is connected to the upper end 8 of the hook weight body 3 via a cutout 7. The cutout 7 has a widening 9 toward the center of the upper end 8 and a semicircular recess 10 toward the center, which together with a partially circular recess 11 on a closing member 12 disposed in the widening 9 forms a circular opening for the passing through of the rope 2.

The rope is connected to the hook weight body 3 via a bolt 13 inserted transversely through the hook weight body and into a corresponding bore, as is shown in FIG. 2. At its end, the rope 2 is provided with a ferrule 15 and a thimble 14 through which the bolt 13 is guided. As FIG. 1 shows, the bolt 13 is secured by a lynch pin 16. A further bore 17 is provided in the hook weight body 3 above the bore receiving the bolt 13. The bore 17 is provided with a holder 18 for a component which can be inserted into the bore 17. The bore for receiving the bolt 13 and the further bore 17 are disposed inside an essentially rectangular depression 19 on the jacket surface of the hook weight body 3. Such a depression 19 is also provided on the other side which cannot be seen in FIG. 1.

From FIG. 2 it can be seen that two downwardly directed flanges (21, 21') are formed on the bottom 20 of the hook weight body 3. The flanges have bores transverse to the longitudinal axis of the hook weight body 3, into which bores a bolt 22 is inserted and secured via a lynch pin 23. This fastening is also evident from FIG. 1.

As FIG. 2 shows, the bracket 24 of the crane hook 4 hangs from the bolt 22. A pivot assembly 25 is attached at the ends of the bracket 24 and connects the bracket to the hook 4*. Moreover, the same. reference characters correspond to the eerie components as in FIG. 1.

Figure 3:
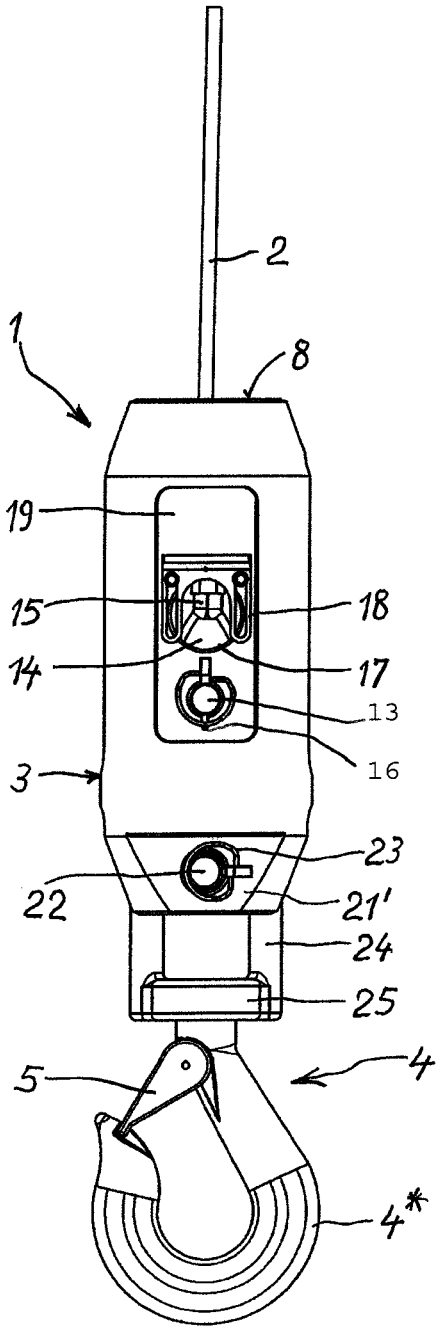
FIG. 3 shows the arrangement in a view in the direction of arrow III of FIG. 2.

FIG. 3 shows a view of the hook weight arrangement 1 in the direction of the arrow III of FIG. 2. The hook weight body 3 hangs on the rope 2 which enters the hook weight body at the top front end 8 and is configured as a thimble 14 at the end thereof. The thimble 14 is partially recognizable through the bore 17. The holder 18 is arranged in the area of the bore 17. The bolt 13 secured by the lynch pin is disposed below the bore 17. The bolt 13 is inserted through the thimble 14 so that the hook weight body 3 is attached to the rope 2. Moreover, the same reference characters correspond to the same components as in FIGS. 1 and 2.

Figure 4:
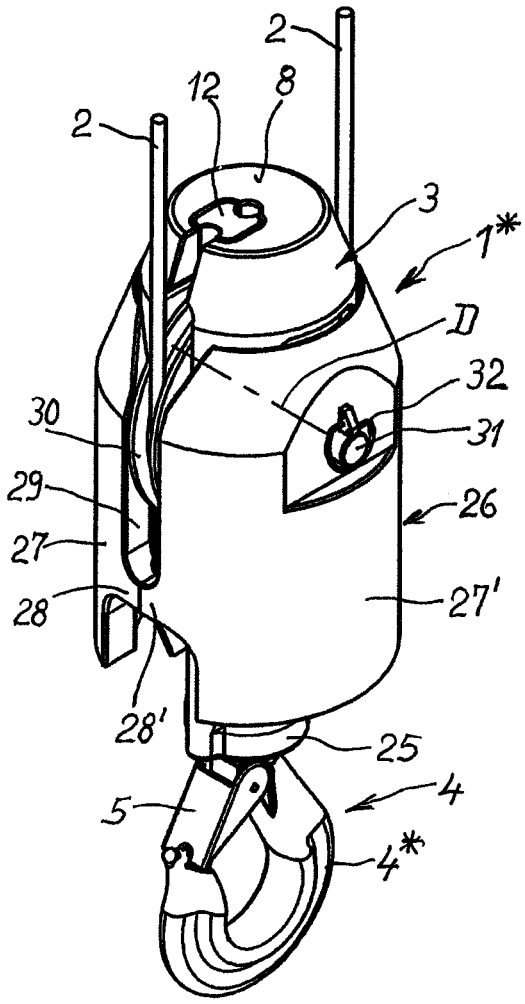
FIG. 4 is a perspective view of a hook weight arrangement with a mounted additional weight on a double pull.

A hook weight arrangement 1* for the double pull of the rope 2 is shown in FIG. 4. One strand of the rope 2 leads to a rope winch of the crane and the other strand is fixed at a fastening point of a crane boom or the like. For the double pull of the rope 2, a rope pulley 30 over which the rope 2 runs is inserted in the hook weight body 3, which is the same in this embodiment as in FIGS. 1 to 3. The rope pulley 30 is rotatably mounted. A rotational axis D is indicated with a broken line in FIG. 4. An additional weight 26 is arranged on the hook weight body 3 in order to increase the tensile force in the rope 2 when there is no load on the crane hook 4. This additional weight 26 is preferably made of gray cast iron and is adapted in the form of two jacket parts (27, 27') disposed on the jacket surface of the hook weight body 3, each having the shape of an annular section and together also having an essentially cylindrical shape like the hook weight body 3.

In the lower region, the jacket parts (27, 27') have protrusions (28, 28') which are directed toward each other and on which the jacket parts come to rest. The same arrangement is provided diametrically on the side of the jacket parts facing away in FIG. 4. Above the protrusions (28, 28'), the jacket parts (27, 27') are spaced from each other so that on each side a gap 29 is formed into which the circumferential edge of the pulley 30 projects and through which the rope 2 runs. The jacket parts (27, 27') are fixed on the hook weight body 3 via a bolt 31 extending along the rotational axis D of the rope pulley 30. A lynch pin 32 is provided to secure the bolt 31. The closing member 12 is inserted on the front end 8 of the hook weight body 3, as previously described in relation to FIG. 1. The hook 4* with pivot assembly 25 is fixed on the bottom of the hook weight body 3 in the same manner as described in relation to FIGS. 2 and 3.

Figure 5:
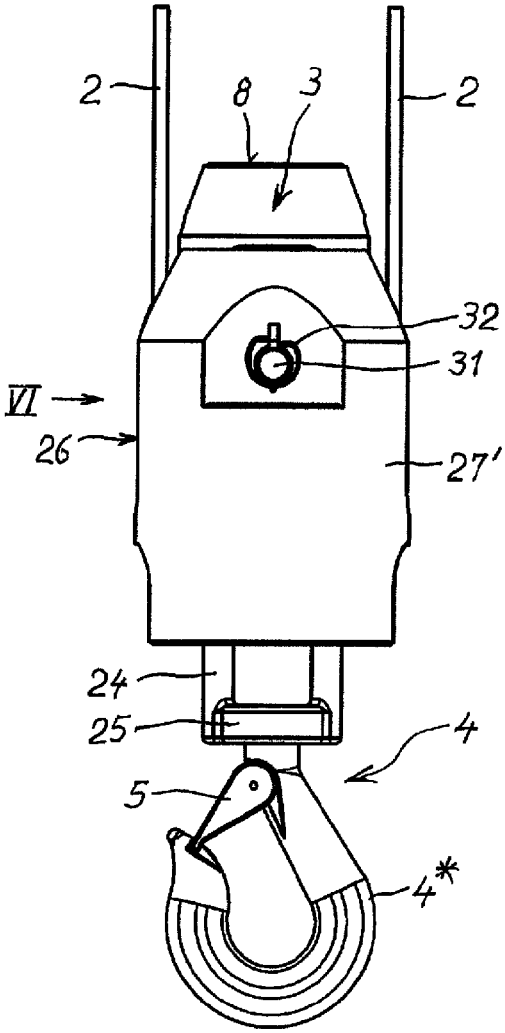
FIG. 5 is a side view of the arrangement of FIG. 4.

FIG. 5 shows the hook weight arrangement 1* according to FIG. 4 in a side view. This shows that the hook 4* with the pivot assembly 25 is fixed on the bracket 24 which, in turn, as can be seen in FIG. 2, is supported by the bolt 22 shown in FIG. 2. The view in FIG. 5 is directed at the jacket part 27'. The hook weight body projects up and beyond the jacket part at the top. To the sides of the hook weight body 3, the strands of the rope 2 are guided upwardly out of the additional weight 26. The end of the bolt 31 with the lynch pin 32 can also be seen.

Figure 6:
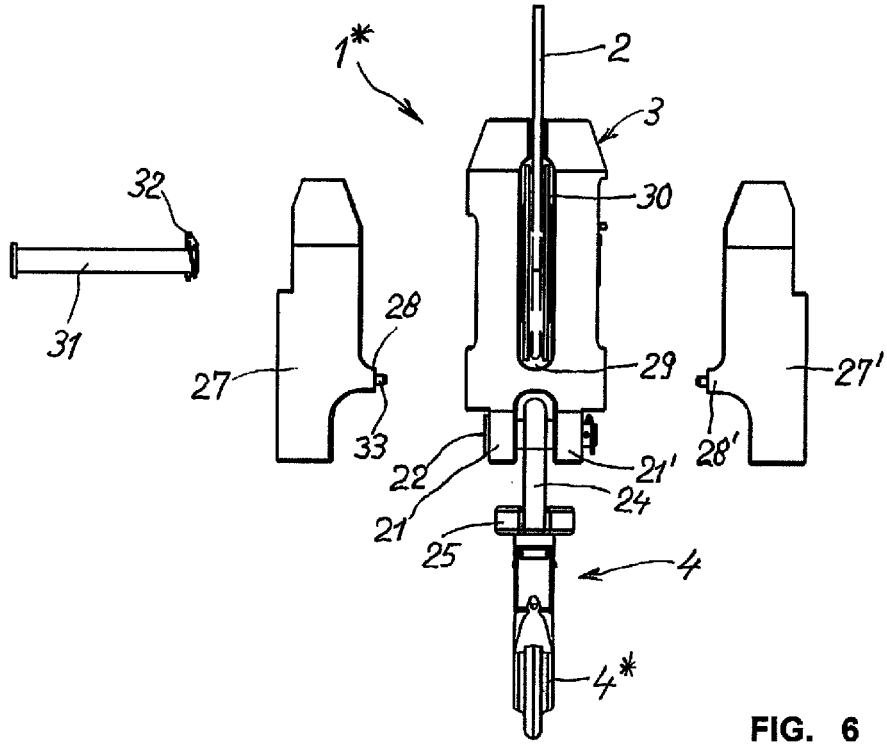
FIG. 6 shows the hook weight arrangement in a view in the direction of the arrow VI of FIG. 5 during assembly.

In FIG. 6, the hook weight arrangement 1* is shown in a view along arrow VI of FIG. 5 during assembly, that is in a condition before the jacket parts (27, 27') are attached to the hook weight body 3. The jacket parts (27, 27') have elements at the projections (28, 28') for the form-fitting engagement; in the shown embodiment, these are a lug 33 at the projection 28 and a corresponding bore in projection 28'. A corresponding arrangement is reversed at the projections at each of the other sides of the jacket parts (27, 27'). The jacket parts (27, 27') rest against the wall of the hook weight body 3, with the simultaneous interlocking of the lug 33 on the projection 28 in the bore of the projection 28'. Then, the bolt 31 is inserted so that it extends through the jacket part 27, the hook weight body 3, the pulley 30, and the jacket part 27'. Subsequently, securing is effected by means of the lynch pin 32. Moreover, the same reference characters correspond to the same components as in FIG. 4.

Figure 7:
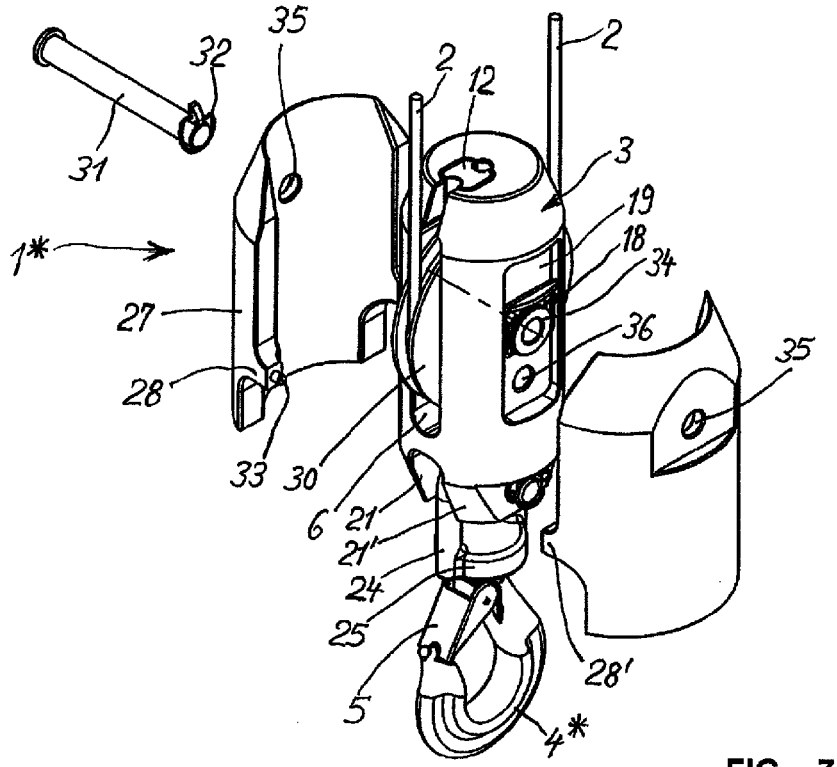
FIG. 7 is a perspective view of the arrangement of FIG. 6.

FIG. 7 shows the hook weight arrangement 1* of FIG. 6 in a perspective view. Therefrom, it can be seen that a sleeve 34 is inserted into the bore 17 shown in FIGS. 1 and 3 and is held by the holder 18. The inner diameter of the sleeve 34 is dimensioned such that the bolt 31 can be inserted through the sleeve 34. The rope pulley 30 is mounted on the sleeve 34. Furthermore, FIG. 7 shows that corresponding bores 35 are arranged in the jacket parts (27, 27'), through which the bolt 31 is inserted for the fixation of the jacket parts (27, 27') on the hook weight body 3. From FIGS. 6 and 7 it becomes clear that the hook weight body 3 is the same as those in FIGS. 1 and 2 and it is only a conversion from a single pull to a double pull of the rope 2 that takes place. The jacket parts (27, 27') can also be mounted on the hook weight body 3 in other ways, for example, by means of conventional screw connection elements or the like. Where appropriate, the additional weight 26 can also be mounted on the hook weight body in the single pull configuration whenever an increased tensile force in the rope is required. Moreover, the same reference characters in FIG. 7 correspond to the same components as in FIGS. 1 and 2.

Figure 8:
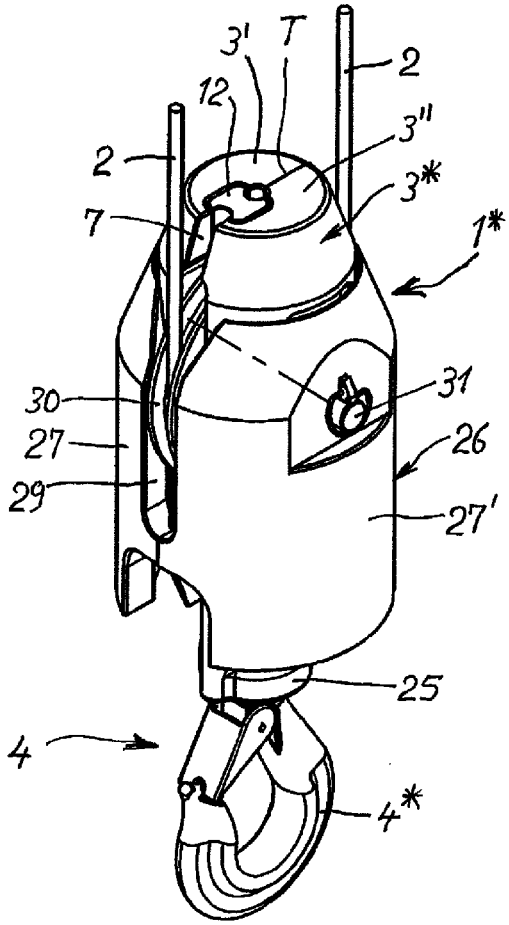
FIG. 8 is a view according to FIG. 4 with a hook weight body divided in the longitudinal direction.

FIG. 8 shows an alternate embodiment of the one shown in FIG. 4. A hook weight body 3* has a partition plane T in its longitudinal direction so that the hook weight body 3* includes two parts 3' and 3". The two parts 3' and 3" are preferably of the same size. In this manner, the parts 3' and/or 3" weighing only half as much as the hook weight arrangement 3 of FIG. 4 can be handled much more easily and are only assembled to form the hook weight body at the location of intended use. Therefore, unloading of the parts from a means of transport and the assembly of the hook weight arrangement 1* is easier and, if required, can be handled by a single person. Of course, the use of the hook weight body 3* consisting of two parts (3', 3") is also possible in the case of a hook weight arrangement 1 configured for a single pull as in FIGS. 1 to 3. The invention presents particular advantages due to the described modular design principle and the universal application with a weight of the hook weight arrangement that can be adapted to the required tensile forces in the rope 2.

It is understood that the foregoing description is that of the preferred embodiments of the invention and that various changes and modifications may be made thereto without departing from the spirit and scope of the invention as defined in the appended claims.

What is claimed is:

1. A crane hook assembly for a crane having a rope drum, the crane hook assembly comprising:

a crane hook;

a rope arranged to be alternately wound onto or unwound from the rope drum of the crane for lifting and lowering said crane hook in a vertical direction;

a hook weight arrangement configured for applying a tension load to said rope;

said hook weight arrangement including a hook weight body connected to said rope and an additional weight configured to be optionally attachable to said hook weight body when needed to impart additional tension to said rope;

said hook weight body defining a longitudinal axis extending in said vertical direction and having an essentially cylindrical section transverse to said axis;

said hook weight body having a lower end and defining an opening configured to have said rope guided therethrough;

said crane hook being attached to said lower end of said hook weight body;

said additional weight including at least two jacket parts shaped as annular sections which conjointly assume an essentially cylindrical form;

said jacket parts annularly surrounding said hook weight body when attached thereto;

said jacket parts being configured to conjointly define two diametrically arranged gaps for guiding said rope therethrough;

a pulley having a peripheral edge and being mounted in said hook weight body; and, said peripheral edge of said pulley projecting into said gaps.

2. The crane hook assembly of claim 1, wherein said opening in said hook weight body is a recess.

3. The crane hook assembly of claim 1, wherein said opening in said hook weight body is a slot.

4. The crane hook assembly of claim 3, further comprising:

a closing member;

said hook weight body having an upper end defining a cutout;

said slot being connected to said upper end via said cutout;

said cutout having a widening formed therein; and, said closing member being seatable in said widening.

5. The crane hook assembly of claim 1, wherein said jacket parts have respective projections directed toward each other whereat said jacket parts come to rest in mutual contact and said projections conjointly define means for formfittingly interlocking said jacket parts.

6. The crane hook assembly of claim 1, wherein said additional weight is a gray iron.

7. The crane hook assembly of claim 1, wherein said jacket parts of said additional weight are fixed on said hook weight body via threaded connectors.

8. The crane hook assembly of claim 1, further comprising:

a set of first bores, one provided in each of said jacket parts of said additional weight;

second bores provided in said hook weight body;

said first bores and said second bores being configured to be coaxial; and, a bolt for fixing said jacket parts.

9. The crane hook assembly of claim 1, wherein said crane hook assembly further comprises:

a bore arranged in said hook weight body and extending transversely to said longitudinal axis; and, a bolt seated in said bore for fixing said rope.

10. The crane hook assembly of claim 1, further comprising:

a bolt;

two flanges arranged on said lower end of said hook weight body configured to receive said bolt;

a bracket mounted on said bolt; and, a pivot assembly for attaching said crane hook to said bracket.

11. The crane hook assembly of claim 1, wherein said hook weight body comprises first and second parts conjointly defining a partition plane extending in the direction of said longitudinal axis.

12. The crane hook assembly of claim 11, wherein said first and second parts of said hook weight body are approximately the same size.

13. A crane hook assembly for a crane having a rope drum, the crane hook assembly comprising:

a crane hook;

a rope arranged to be alternately wound onto or unwound from the rope drum of the crane for lifting and lowering said crane hook in a vertical direction;

a hook weight arrangement configured for applying a tension load to said rope;

said hook weight arrangement including a hook weight body connected to said rope and an additional weight configured to be optionally attachable to said hook weight body when needed to impart additional tension to said rope;

said hook weight body defining a longitudinal axis extending in said vertical direction and having an essentially cylindrical section transverse to said axis;

said hook weight body having a lower end and defining an opening configured to have said rope guided therethrough;

said crane hook being attached to said lower end of said hook weight body;

said additional weight including at least two jacket parts shaped as annular sections which conjointly assume an essentially cylindrical form;

said jacket parts annularly surrounding said hook weight body when attached thereto;

a set of first bores, one provided in each of said jacket parts of said additional weight;

second bores provided in said hook weight body;

said first bores and said second bores being configured to be coaxial;

a bolt for fixing said jacket parts;

a pulley for accommodating said rope;

said second bores having a larger diameter than said first bores; and, a sleeve arranged in said second bores on which said pulley is mounted.

14. The crane hook assembly of claim 13, further comprising holders arranged at said second bores for accommodating said sleeve.

* * * * *

UNITED STATES PATENT AND TRADEMARK OFFICE

CERTIFICATE OF CORRECTION

PATENT NO. : 8,763,993 B2
APPLICATION NO. : 13/111255
DATED : July 1, 2014
INVENTOR(S) : Stefan Böhler It is certified that error appears in the above-identified patent and that said Letters Patent is hereby corrected as shown below:

In the Specification

In Column 3:
Line 49: delete "same." and insert -- same -- therefor.
Line 50: delete "eerie" and insert -- same -- therefor.

Signed and Sealed this
Seventh Day of October, 2014

Michelle K. Lee

Michelle K. Lee
*Deputy Director of the United States Patent and Trademark Office*